United States Patent [19]

Nittel et al.

[11] 4,233,398

[45] Nov. 11, 1980

[54] PROCESS FOR THE HARDENING OF PHOTOGRAPHIC LAYERS UTILIZING FAST ACTING HARDENER AND POLYSACCHARIDE

[75] Inventors: Fritz Nittel; Karl Czernik; Wolfgang Sauerteig; Wolfgang Himmelmann, all of Leverkusen; Peter Bergthaller, Cologne, all of Fed. Rep. of Germany

[73] Assignee: AGFA-Gevaert, A.G., Leverkusen, Fed. Rep. of Germany

[21] Appl. No.: 881,027

[22] Filed: Feb. 24, 1978

Related U.S. Application Data

[63] Continuation-in-part of Ser. No. 565,416, Apr. 7, 1975, abandoned.

[30] Foreign Application Priority Data

Apr. 11, 1974 [DE] Fed. Rep. of Germany ..... 2417779

[51] Int. Cl.[2] ..... G03C 1/76; G03C 1/30; G03C 1/02

[52] U.S. Cl. ..... 430/495; 430/531; 430/621; 430/623; 430/631; 430/639; 430/628; 260/117; 106/125

[58] Field of Search ..... 96/111, 114.3, 67; 260/117; 106/125

[56] References Cited

U.S. PATENT DOCUMENTS

| | | | |
|---|---|---|---|
| 3,085,009 | 4/1963 | Chambers | 96/111 |
| 3,098,693 | 7/1963 | Sheehan | 96/111 |
| 3,533,800 | 10/1970 | King | 96/111 |
| 3,767,410 | 10/1973 | Brust et al. | 96/114.3 |
| 3,880,665 | 4/1975 | Himmelmann | 96/111 |

FOREIGN PATENT DOCUMENTS

| | | | |
|---|---|---|---|
| 1275587 | 5/1972 | United Kingdom | 96/111 |

*Primary Examiner*—Won H. Louie, Jr.
*Attorney, Agent, or Firm*—Connolly & Hutz

[57] ABSTRACT

Protein containing photographic layers are hardened by coating with a hardening solution which contains at least one quick-acting hardener which activates carboxyl groups and at least one polysaccharide.

2 Claims, No Drawings

PROCESS FOR THE HARDENING OF PHOTOGRAPHIC LAYERS UTILIZING FAST ACTING HARDENER AND POLYSACCHARIDE

CROSS REFERENCE

This application is a continuation-in-part of parent U.S. application Ser. No. 565,416 filed Apr. 7, 1975 by Fritz Nittel et al for "Process For The Hardening Of Photographic Layers", now abandoned.

This invention relates to a process for the hardening of photographic layers which contain protein, in particular gelatine, using quick-acting hardeners.

The use of quick-acting hardeners for photographic purposes instead of hardeners which act over a prolonged period has recently become increasingly important. With the rapid progress of the hardening reaction it is possible to avoid changes in the photographic materials during storage which result among other effects in a continuous decrease in the permeability of the photographic layers to photographic baths and undesirable sensitometric effects such as reduction in contrast.

The use of quick-acting hardeners in photographic layer does, however, entail difficulties, particularly in the technique of casting.

When conventional casting apparatus is employed for the preparation of photographic layers, in which part of the casting solution is returned to the storage container and only one layer is applied at a time, it is not possible to add the hardener as required since the hardening reaction would take place within the casting apparatus and block the casting process within a short time. These difficulties are well known and numerous methods are available to overcome them, for example the addition of copolymers of acrylic acid acrylate, as described, for example, in British Pat. No. 1,275,587. However, the addition of these compounds increases the swelling of the layers, e.g. in the case of carbodiimides and isoxazolium salts. Difficulties also arise where suction casting apparatus is used. Firstly, the dried layers are already hardened to such a degree that the layers applied subsequently do not adhere firmly to them and secondly the casting solution containing the hardener is already partly overhardened so that compact particles are deposited on the edges of the casting apparatus and in the casting device itself and thus have a deleterious effect on the flow and quality of casting.

Attempts have therefore been made to incorporate the quick-acting hardeners in the photographic layers after their preparation, by treating the prepared layers with solutions of the hardeners either by bathing the layers in the hardening compounds or by pouring aqueous solutions of these compounds on the layers. It has also been attempted to apply the hardening compounds together with covering or protective layers to the multi-layered unit and then give the hardening compounds the opportunity to diffuse into the underlying layers. The first mentioned method of incorporating the compounds by bathing the layers in them has, however, the disadvantage that the photographic material must be dried before it is treated with the hardening bath and moreover a different system of application is required for this treatment than that used for preparation of the layers. When the method of pouring aqueous solutions of the hardener over the layers is employed, difficulties arise because the photographic material over which the solutions are poured is not sufficiently wettable and consequently it is difficult to apply the quantity of hardener required for completely hardening the multi-layered unit.

Application of the hardening compounds together with a covering or protective layer which contains gelatine has the disadvantages already mentioned above, namely faults in the operation of the casting apparatus due to premature onset of the hardening reaction.

It is therefore an object of this invention to provide a process for the hardening of photographic layers by means of quick-acting hardeners which can be carried out using the conventional application devices for preparing photographic layers without trouble arising due to the short reaction time of the quick-acting hardeners.

A process for the preparation of photographic layers which contain protein, in particular gelatine, with the aid of quick-acting hardeners has now been found in which photographic layers which are not yet hardened or have undergone only slight preliminary crosslinking are coated with hardening solutions which contain as their major constituents at least one quick-acting hardener which activates carboxyl groups and at least one polysaccharide which is a linear polymer in which either (1) at least one-third of the monosaccharide units have a 1–2 bond and the remaining monosaccharide units have a 1–4 bond or (2) substantially all the monosaccharide units have a 1–4 bond and at least 50% of the hydroxyl groups of the monosaccharide units are acetylated or replaced by an $OSO_3Me$-group, where Me represents an alkali metal.

By quick-acting hardeners are meant in this context compounds which bring about cross-linking of the gelatine within a very short time, if possible during the drying process, and by which maximum cross-linking is achieved within 24 hours. The advantage of these quick-acting hardeners is that the photographic material prepared with such hardeners does not undergoe any change either sensitometrically or in its swelling properties, even during prolonged storage.

A common feature of all the quick-acting hardeners used according to the invention is that they activate carboxyl groups. This action may be explained using the example of the known reaction of carbodiimides with carboxylic acids. In this reaction, N-acyl ureas or acid anhydrides are used as activating groups. In the case of proteins which contain carboxyl and amino groups, the reaction proceeds further and the activated carboxyl groups form peptide bonds with the amino groups. These compounds are therefore also known as peptide reagents (Chemical Reviews 67 (1967) pages 107 to 152).

Since the hardeners used according to the invention react very rapidly with proteins, as already described above, it is undesirable to use them in protein solutions, such as gelatine solutions, as top coating solutions. It is, however, desirable to use a coating colloid comprising a high-molecular weight compound which does not react with the hardener and at the same time has good layer-forming properties. Polysaccharides have proved to be particularly suitable for this purpose.

The coating colloid consisting essentially of a polysaccharide or polysaccharides and the referred-to quick-acting hardener is coatable on the top of a layer containing gelatin in the photographic material so that the quick-acting hardener when thus applied reacts with the gelatin, in which reaction the quick-acting hardeners of this invention activate carboxyl groups of the gelatin while at the same time that the polysaccharide of the composition is reacting with the gelatin the composition provides the advantage of layer-forming. As illustrated below in the specific Examples, this formed layer is compatible with the desired results with the photographic material.

The polysaccharides suitable for the process according to the invention are straight chain polymers in which either (A) at least one third of the monosaccharide units are linked in the 1-2-position and the remaining monosaccharide units are linked in the 1-4 position or (B) substantially all the monosaccharide units are linked in the 1-4-position and at least 50% of the hydroxyl groups of the monosaccharide units are acetylated or replaced by an $OSO_3Me$-group in which Me represents an alkali metal.

As will be more apparent upon consideration of the following description, the coating composition of this invention containing the described quick-acting hardener and a polysaccharide provides the advantage applying a coating composition which is unhardened, wets the coated surface, is layer-forming and from which the quick-acting hardener reacts into the coated gelatin-containing layer resulting in a desirable photographic material.

Examples of such polysaccharides include the polymers which can be synthesised by biosynthesis from special strains of bacteria and which are named after the bacteria which bring about this biosynthesis, e.g. B-1459 and B-1973. This nomenclature is conventionally used in the literature and makes it possible for the polysaccharides to be identified uniquely. Further information on the two above mentioned polysaccharides B-1459 and B-1973 may be found in the articles by D. G. Orentas et al, Canadian J. Micro Biology, 9.427 (1963); J. H. Sloneker et al, Canadian J. Chemistry, 46, 353 (1968); L. L. Wallen et al, Applied Micro Biology, 13, 272 (1965); M. E. Slodke, Biochem. Biophys. acta 69 and in U.S. Pat. Nos. 3,383,307; 3,516,983; 3,391,061 and 3,000,790.

A further example of a polysaccharide suitable for the process according to the invention is the cellulose sulphate KELCO SCS supplied by KELCO Company, New Jersey, USA, to which the following formula is attributed:

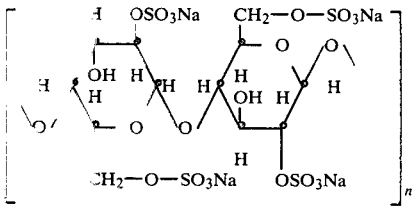

Another trade product of KELCO Company suitable for the process of the invention is KELZAN, which corresponds to polysaccharide B-1459.

The quick-acting hardeners used according to the invention with the above mentioned polysaccharides belong to a group of compounds which are represented by the following general formulae:

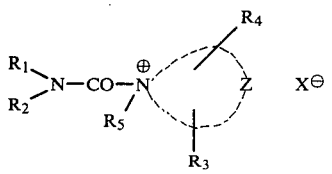

(I)

in which $R_1$ represents an alkyl group which may be substituted, preferably an alkyl group containing 1 to 3 carbon atoms, an aryl group which may be substituted preferably with a lower alkyl group or with halogen, e.g. phenyl which may be substituted with methyl, ethyl, propyl, chlorine or bromine, or an aralkyl group, e.g. benzyl, which may be substituted in the same way as the aryl group, $R_2$ may represent the same group as $R_1$ or a double-bonded, alkylene, arylene, aralkylene or alkyl-aryl-alkyl group any of which may be substituted, e.g. an ethylene, propylene, phenylene or xylylene group, which is connected through its second bond to another carbamoyl ammonium group of the formula

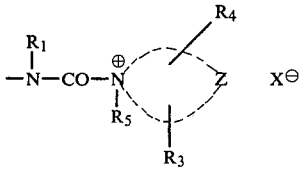

or $R_1$ and $R_2$ may together represent the atoms required to complete an piperidine, piperazine or morpholine ring, which ring may be substituted, e.g. with an alkyl group containing 1 to 3 carbon atoms or with halogen such as chlorine or bromine, $R_3$ represents a hydrogen atom, an alkyl group containing 1 to 3 carbon atoms or the group $\text{-}[A]_\alpha$ in which A represents a vinyl group of a polymerised vinyl compound or a copolymer with other copolymerisable monomers and $\alpha$ denotes a number such that the molecular weight of the compound is greater than 1000, $R_4$ represents a hydrogen atom or an alkyl group containing 1 to 3 carbon atoms or, if Z represents the atoms required to complete a pyridinium ring and $R_3$ is absent, $R_4$ represents one of the following groups: $—NR^6—CO—R^7$ in which $R^6$ represents hydrogen or an alkyl group which contains 1 to 4 carbon atoms $R^7$ represents hydrogen or an alkyl group which contains 1 to 4 carbon atoms or the group $NR^8R^9$ in which $R^8$, $R^9$ which may be the same or different, represents hydrogen or an alkyl group which contains 1 to 4 carbon atoms $—(CH_2)_m—NR^{10}R^{11}$ in which $R^{12}$ represents $—CO—R^{12}$ $R^{11}$ represents hydrogen or an alkyl group which contains 1 to 4 carbon atoms $R^{12}$ represents hydrogen, an alkyl group which contains 1 to 4 carbon atoms, or the group $NR^{13}R^{14}$ in which $R^{13}$ represents an alkyl group which contains 1 to 4 carbon atoms or an alkyl group $R^{14}$ represents hydrogen or an alkyl or aryl group m=1 to 3 $—(CH_2)_n—CONR^{15}R^{15}$ in which $R^{15}$ represents hydrogen, an alkyl group which contains 1 to 4 carbon atoms or an aryl group $R^{16}$ represents hydrogen or an alkyl group which contains 1 to 4 carbon atoms $R^{15}$ and $R^{16}$ together form the atomic group required to complete a 5- or 6-membered aliphatic ring, n=0 to 3

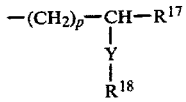

$R^{17}$ represents hydrogen or an alkyl group which contains 1 to 4 carbon atoms which may be substituted with halogen, Y represents —O— or the group —$NR^{19}$ $R^{18}$ represents hydrogen, an alkyl group or the group —CO—$R^{20}$ or —CO—$NHR^{21}$, $R^{19}$, $R^{20}$, $R^{21}$ which may be the same or different represent hydrogen or an alkyl group which may contain 1 to 4 carbon atoms p=2 or 3

$R_5$ represents an alkyl, aryl or aralkyl group but is absent if the nitrogen to which $R^5$ is attached carries a double bond in the heterocyclic aromatic ring formed by Z, Z represents the atoms required to complete a substituted or unsubstituted, 5- or 6-membered, heterocyclic aromatic ring or a condensed system such as isoquinoline, which atomic group may contain other hetero atoms in addition to the nitrogen atom, for example oxygen or sulphur, and X represents an anion, e.g. halogen ⊖, $BF_4$⊖, $NO_3$⊖, $SO_4$⊖, $ClO_4$⊖ or $CH_3OSO_3$⊖;

(II) carbamoyloxy pyridinium compounds of the formula

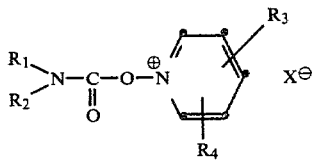

in which $R_1$ represents an alkyl group containing 1 to 3 carbon atoms or an aryl group such as phenyl, $R_2$ represents an alkyl group containing 1 to 3 carbon atoms or the group

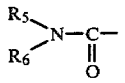

in which $R_5$ represents hydrogen or an alkyl group such as a methyl or ethyl group and $R_6$ represents an alkyl group such as methyl or ethyl group or $R_1$ and $R_2$ together represents the atoms required to complete a heterocyclic system such as pyrrolidine, morpholine, piperidine, perhydroazepine, 1,2,3,4-tetrahydroquinoline or imidazolidine-2—OH—ring or $R_1$ and $R_2$ together represents the atoms required to complete a piperazine ring in which the second nitrogen atom establishes the link to a second, similar molecular grouping corresponding to the general formula, $R_3$ represents hydrogen, halogen such as chlorine and bromine, an alkyl group such as methyl and ethyl, a hydroxyalkyl group containing 1 to 3 carbon atoms or a cyanogen, —$CONH_2$ or

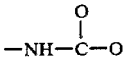

alkyl (such as methyl, ethyl) group, $R_4$ represents hydrogen or an alkyl group such as a methyl or ethyl group and X represents an anion such as Cl—, $BF_4$— or $ClO_4$—

(III) carbodiimides of the formula

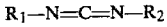

in which $R_1$ and $R_2$ which may be the same or different represent alkyl groups such as methyl, ethyl, n-propyl, isopropyl, m-butyl, secondary butyl, isobutyl, tert.-butyl, amyl, hexyl, cyclohexyl; alkoxy alkyl groups such as methoxy- or ethoxy-ethyl, -propyl or -amyl or aryl groups such as phenyl, benzyl and β-phenyl ethyl, ethyl morpholinyl, diethylaminoethyl, ethyl pyridyl, α-, β-and γ-methyl pyridyl or ethyl pyridyl, or $R_1$ represents an alkyl group preferably containing 1 to 5 carbon atoms and $R_2$ represents the group

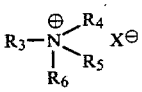

in which $R_3$ represents an alkyl group preferably containing 1 to 5 carbon atoms, $R_4$ and $R_5$ represents alkyl groups preferably containing 1 to 3 carbon atoms or $R_4$ and $R_5$ together form a 6-membered heterocyclic ring containing one or two heteroatoms such as

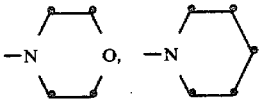

$R_6$ represents hydrogen or a lower alkyl group and X represents an anion such as chloride, bromide or toluene sulphonate;

(IV) dihydroquinoline derivatives of the formula

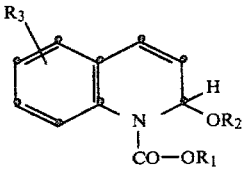

in which $R_1$ represents an alkyl group containing 1 to 4 carbon atoms which may be unsubstituted or substituted with alkyloxy, e.g. with methoxy or ethoxy, or with halogen, e.g. with chlorine or bromine, $R_2$ represents an alkyl group containing 1 to 4 carbon atoms, which may be unsubstituted or substituted with alkoxy, e.g. methoxy or ethoxy; halogen, e.g. chlorine; dialkylamino or trialkyl ammonium, e.g. dimethyl or diethylamino, trimethyl- or triethyl ammonium; e.g. phenyl, or with alkyl sulphonyl, e.g. methyl sulphonyl or ethyl sulphonyl, or, when $R_3$ is absent, $R_2$ represents the group

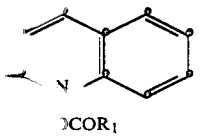

$R_3$ represents hydrogen, halogen, e.g. chlorine or bromine; alkoxy, e.g. methoxy or ethoxy, or alkyl, e.g. methyl ethyl or propyl.

The quick-acting hardeners indicated above are known per se. Details concerning their preparation and properties may be found in the publications mentioned below. Carbamoyl pyridinium compounds corresponding to formula (I) from German Offenlegungsschrifts No. 2,245,635 and . ... ... (P 23 17 677.4); carbamoyloxy pyridinium compounds of formula (II) from German Offenelgungsschrift No. . ... ... (P 24 08 814.0); carbodiimides corresponding to formula (III) from U.S. Pat. Nos. 2,938,892 and 3,098,693 and the articles by E. Schmidt, F. Hitzler and E. Lahde in Ber, 71, 1933 (1938) or by G. Amiard and R. Heynes in Bull. Soc. Chim. France 1360 (1956); and lastly, dihydroquinoline compounds corresponding to formula (IV) from German Offenlegungsschrift No. ... ... (P 23 32 317.3).

The following are examples of quick-acting compounds corresponding to formulae I to IV:

Compound according to formula I

I. 1.

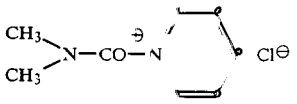

syrup highly hygroscopic

I. 2.

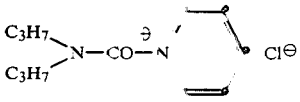

syrup highly hygroscopic

I. 3.

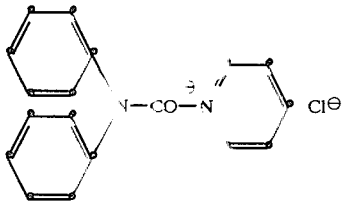

Mp. 112° C.

I. 4.

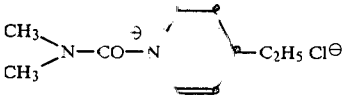

Mp. 103° C.

I. 5.

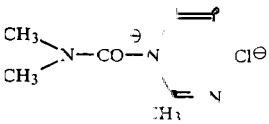

Mp. 87–89° C.

-continued

I. 6.

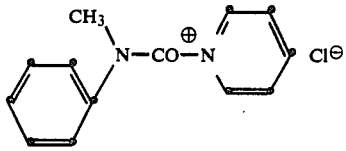

Mp. 108–110° C.

I. 7.

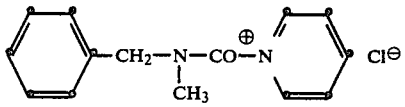

syrup, hygroscopic

I. 8.

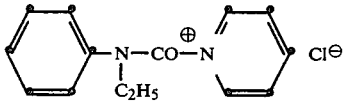

Mp. 105–107° C.

I. 9.

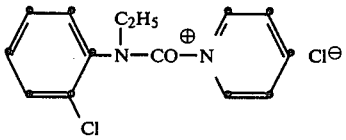

Syrup

I. 10.

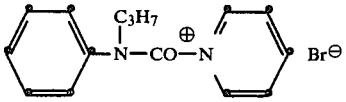

Mp. 103–105° C.

I. 11.

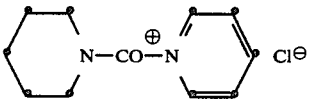

Mp. 75–77° C.

I. 12.

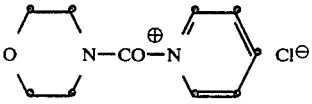

Mp. 110–112° C.

I. 13.

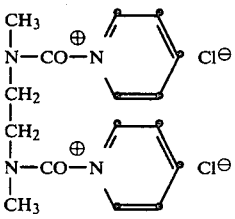

Mp. 95–96° C.

I. 14.

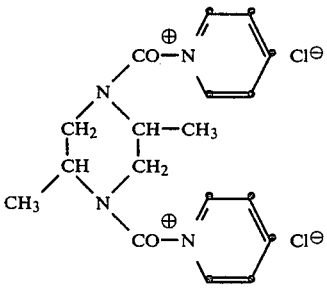

Mp. 106° C.

-continued
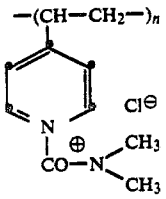
molecular weight above 10,000
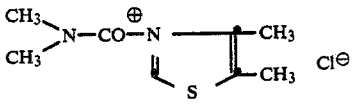
Mp. 66–68° C.
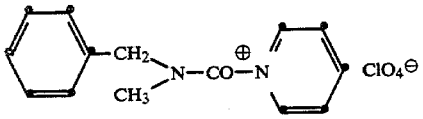
syrup, hygroscopic
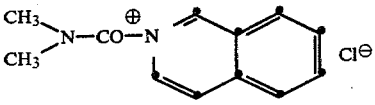
oil.
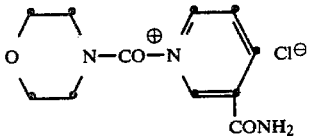
M.p. 103–105° C.
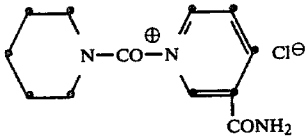
oil
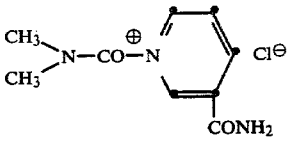
M.p. 109° C.
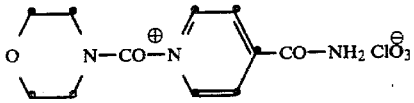
M.p. 158° C.
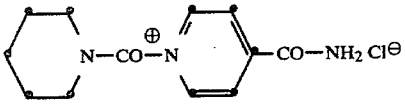
oil
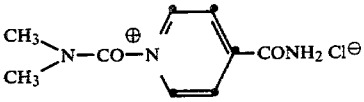
M.p. 115° C.
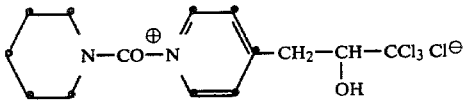
M.p. 154° C.
-continued
I. 15.
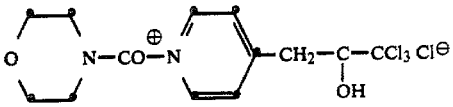
M.p. 140° C.
I. 16.
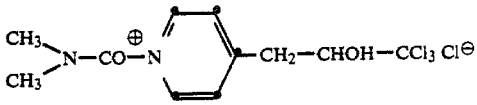
M.p. 115° C.
I. 17.
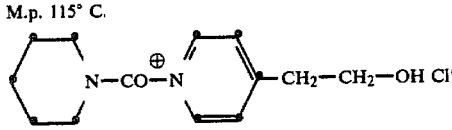
M.p. 152° C.
I. 18.
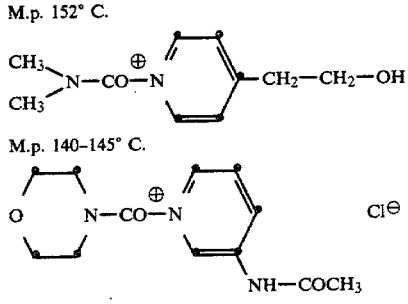
M.p. 140–145° C.
I. 19.
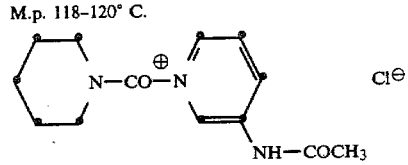
M.p. 118–120° C.
I. 20.
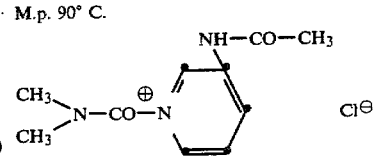
M.p. 90° C.
I. 21.
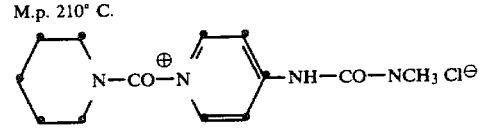
M.p. 210° C.
I. 22.
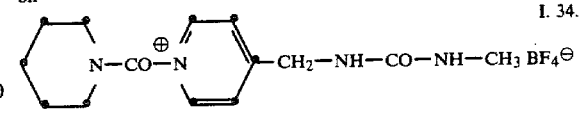
oil
I. 23.
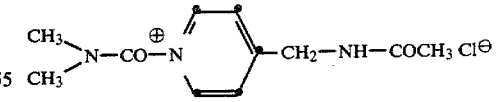
oil
I.24.
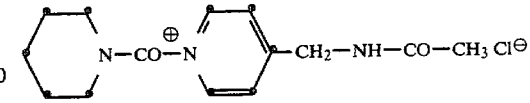
oil
I.25.
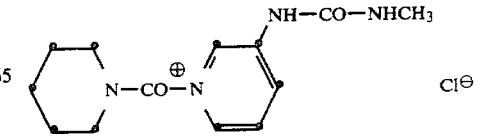
M.p. 60–65° C.
I. 26.
I. 27.
I. 28.
I. 29.
I. 30.
I. 31.
I. 32.
I. 33.
I. 34.
I. 35.
I. 36.
I. 37.

-continued
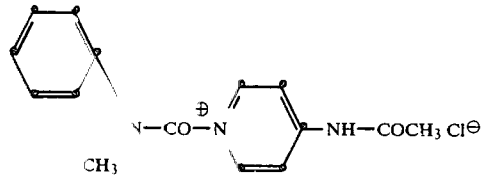
syrup, hygroscopic
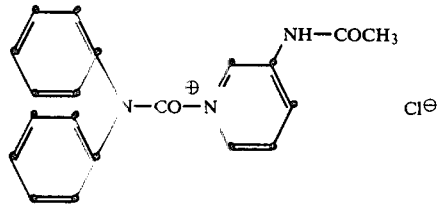
-continued
I. 38. M.p. 110° C.
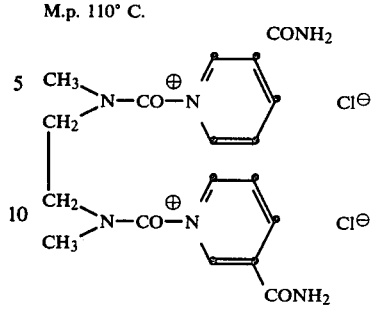
I. 39.
syrup, hygroscopic
I. 40.
Compound according to formula II:
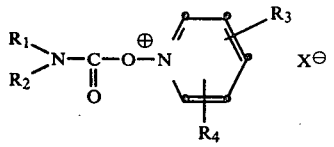
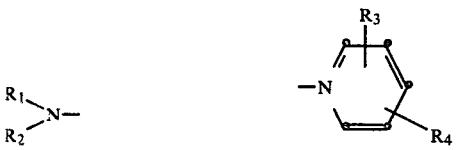
| Subst. Nr. | $R_1R_2N$ | | $X^\ominus$ | Fp. Zers. |
|---|---|---|---|---|
| 1 | $(CH_3)_2N$ | 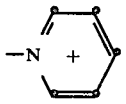 | $Cl^\ominus$ | 163–67° |
| 2 | " | 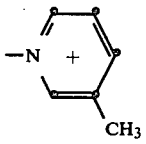 | $Cl^\ominus$ | 168–70° |
| 3 | " | 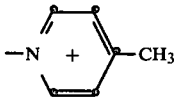 | $Cl^\ominus$ | 86° |
| 4 | " | 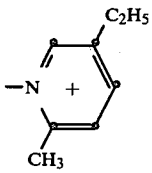 | $Cl^\ominus$ | 90° |
| 5 | " | 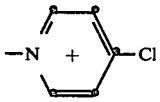 | $ClO_4^\ominus$ | 100–102° |
| 6 | " | 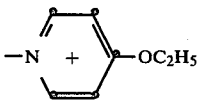 | $ClO_4^\ominus$ | 95–100° |
| 7 | " | 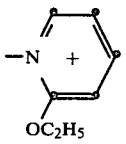 | $ClO_4^\ominus$ | 100–102° |

-continued
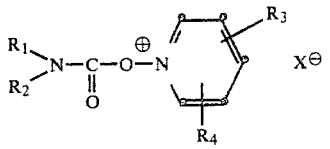
| Subst. Nr. | $R_1R_2N$ | 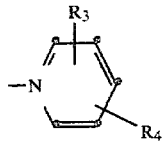 | $X^{\ominus}$ | Fp. Zers. |
|---|---|---|---|---|
| 8 | $(CH_3)_2N$ | 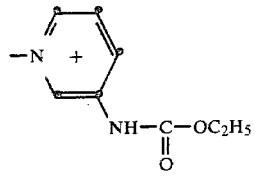 | $ClO_4^{\ominus}$ | 150° |
| 9 | $(C_2H_5)_2N$ | 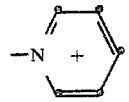 | $Cl^{\ominus}$ | 108–110° |
| 10 | " | 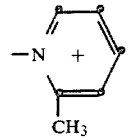 | $ClO_4^{\ominus}$ | 64–65° |
| 11 | " | 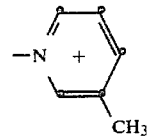 | $ClO_4^{\ominus}$ | 130–32° |
| 12 | " | 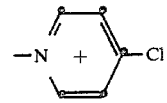 | $Cl^{\ominus}$ | 95–100° |
| 13 | 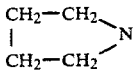 | 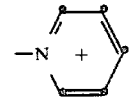 | $Cl^{\ominus}$ | 114–115° |
| 14 | 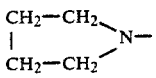 | 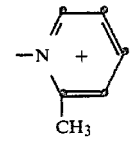 | $Cl^{\ominus}$ | 90–92° |
| 15 | 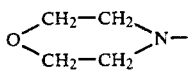 | 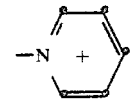 | $Cl^{\ominus}$ | 132° |
| 16 | " | " | $BF_4^{\ominus}$ | 138–40° |
| 17 | " | " | $ClO_4^{\ominus}$ | 150–52° |
| 18 | " | 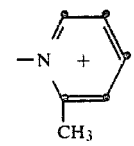 | $Cl^{\ominus}$ | 110–13° |
| 19 | " | " | $ClO_4^{\ominus}$ | 140–42° |

-continued
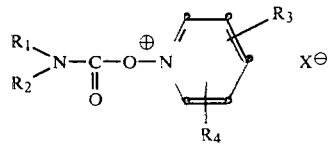
| Subst. Nr. | $R_1$, $R_2$ | | $X^{\ominus}$ | Fp. Zers. |
|---|---|---|---|---|
| 20 | | 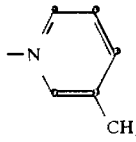 | $Cl^{\ominus}$ | 130–32° |
| 21 | | 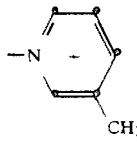 | $ClO_4^{\ominus}$ | 144–46° |
| 22 | 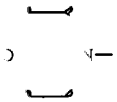 | 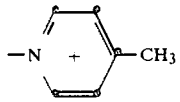 | $Cl^{\ominus}$ | >90° |
| 23 | | 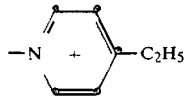 | $Cl^{\ominus}$ | 100–102° |
| 24 | | 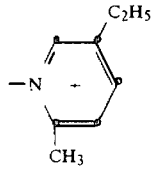 | $Cl^{\ominus}$ | 102–104° |
| 25 | | 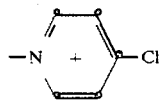 | $Cl^{\ominus}$ | 100–102° |
| 26 | | 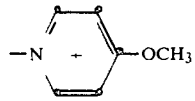 | $Cl^{\ominus}$ | 113–115° |
| 27 | | 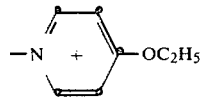 | $Cl^{\ominus}$ | >115° |
| 28 | | 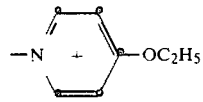 | $ClO_4^{\ominus}$ | 112–14° |
| 29 | | 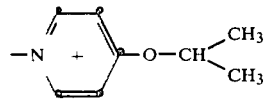 | $Cl^{\ominus}$ | 93–95° |
| 30 | | 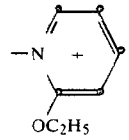 | $Cl^{\ominus}$ | 65–70° |
| 31 | | | $BF_4^{\ominus}$ | 144–48° |

-continued
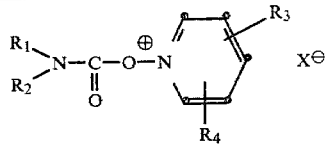
| Subst. Nr. | $R_1R_2N$ | | $X^{\ominus}$ | Fp. Zers. |
|---|---|---|---|---|
| 32 | " | 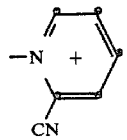 | $Cl^{\ominus}$ | 80–82° |
| 33 | " | 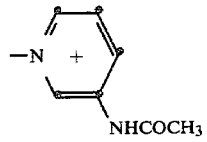 | $ClO_4^{\ominus}$ | 150° |
| 34 | " | 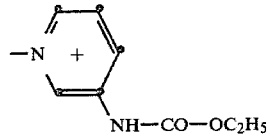 | $ClO_4^{\ominus}$ | 162–63° |
| 35 | " | 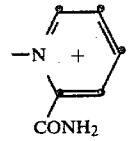 | $ClO_4^{\ominus}$ | 200° |
| 36 | 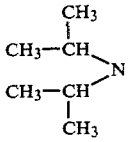 | 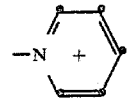 | $Cl^{\ominus}$ | 158° |
| 37 | " | 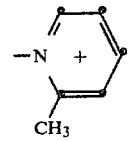 | $Cl^{\ominus}$ | 138° |
| 38 | " | 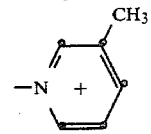 | $Cl^{\ominus}$ | 152–154° |
| 39 | 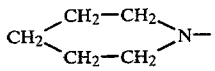 | 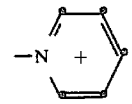 | $Cl^{\ominus}$ | 85–86° |
| 40 | " | 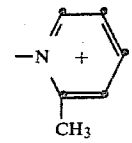 | $ClO_4^{\ominus}$ | 100° |
| 41 | " | 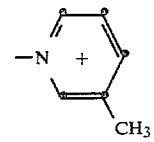 | $ClO_4^{\ominus}$ | 80° |

-continued
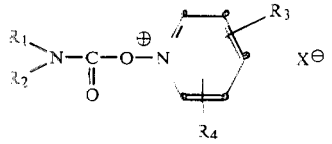
| Subst. Nr. | | | $X^{\ominus}$ | Fp. Zers. |
|---|---|---|---|---|
| 42 | | 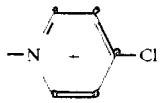 | $Cl^{\ominus}$ | 104–106° |
| 43 | 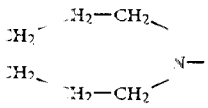 | 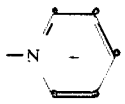 | $Cl^{\ominus}$ | 76–78° |
| 44 | 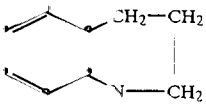 | | $Cl^{\ominus}$ | 140–144° |
| 45 | 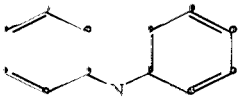 | | $Cl^{\ominus}$ | 160–162° |
| 46 | | 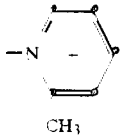 | $Cl^{\ominus}$ | 98–100° |
| 47 | | 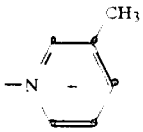 | $Cl^{\ominus}$ | 218–220° |
| 48 | | 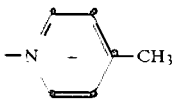 | $Cl^{\ominus}$ | 116° |
| 49 | | 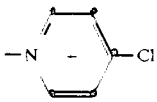 | $Cl^{\ominus}$ | 125–128° |
| 50 | 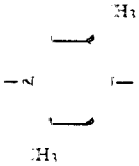 | 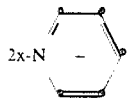 | 2 $Cl^{\ominus}$ | 109–112° |
| 51 | 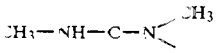 | 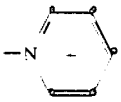 | $Cl^{\ominus}$ | 87–89° |
| 52 | | 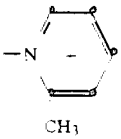 | $Cl^{\ominus}$ | 105° |

-continued
| Subst. Nr. | $R_1R_2N-$ | 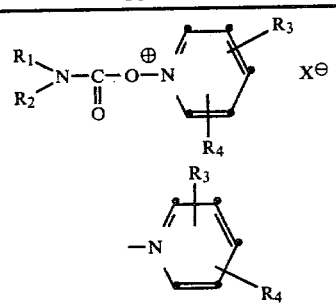 | $X^{\ominus}$ | Fp. Zers. |
|---|---|---|---|---|
| 53 | " | 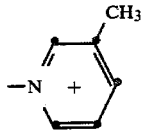 | $Cl^{\ominus}$ | 88–89° |
| 54 | 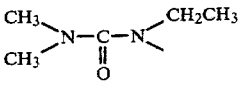 | 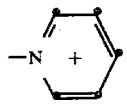 | $Cl^{\ominus}$ | 168–170° |
| 55 | 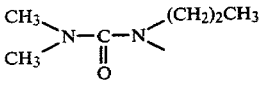 | " | $Cl^{\ominus}$ | 169–173° |
| 56 | 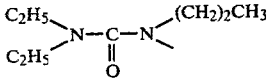 | " | $Cl^{\ominus}$ | 173–180° |
| 57 | 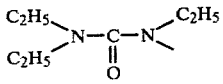 | " | $Cl^{\ominus}$ | 173–183° |
| 58 | 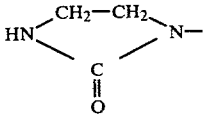 | " | $Cl^{\ominus}$ | 221–223° |
| 59 | " | 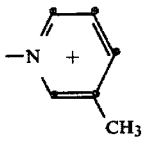 | $Cl^{\ominus}$ | 180–185° |
Compound according to formula III:
1. $C_2H_5-N=C=N-C_2H_5$
2. $CH_2=CH-CH_2-N=C=N-CH_2-CH=CH_2$
3. $CH_3O-CH_2-CH_2-N=C=N-CH_2-CH_2-OCH_3$
4. 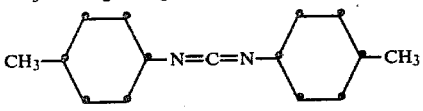
5. $C_2H_5-(CH_3)CH-N=C=N-CH(CH_3)-C_2H_5$
6. $(C_2H_5)_2N-CH_2-CH_2-N=C=N-CH_2-CH_2-N(C_2H_5)_2$
7. 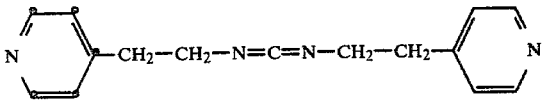
8. $CH_3-N=C=N-CH(CH_3)_2$
9. $C_2H_5-N=C=N-(CH_2)_2-OCH_3$
10. 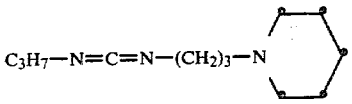

-continued

11.

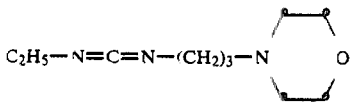

12.

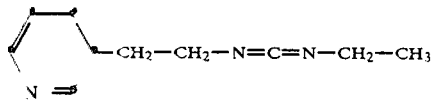

13.

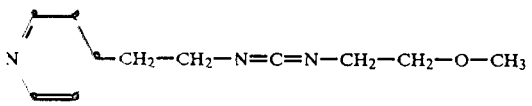

14. $CH_3-N=C=N-(CH_2)_3-\overset{\oplus}{N}(CH_3)_2$ $Cl^{\ominus}$
H

15. $C_2H_5-N=C=N-(CH_2)_3-\overset{\oplus}{N}(CH_3)_2$ $Cl^{\ominus}$
H

16. $C_2H_5-N=C=N-(CH_2)_3-\overset{\oplus}{N}(CH_3)_3$ $Cl^{\ominus}$

17. $C_5H_{11}-N=C=N-(CH_2)_3-\overset{\oplus}{N}(C_2H_5)_2$ $Cl^{\ominus}$
H

18.

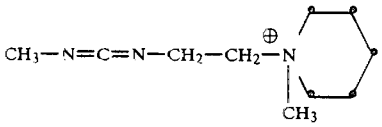

$X^{\ominus}$

19.

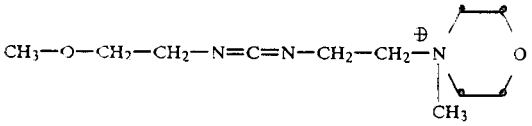

$Cl^{\ominus}$

20.

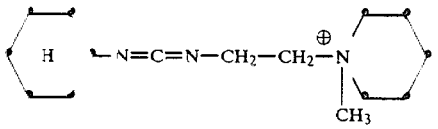

$Cl^{\ominus}$

21.

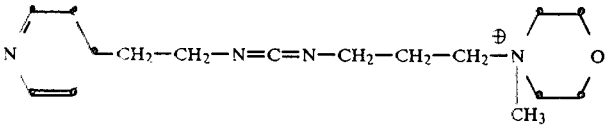

$Cl^{\ominus}$

Compound according to formula IV

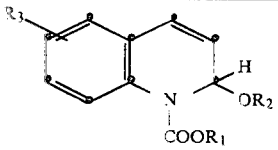

| Nr. | $R_1$ | $R_2$ | $R_3$ | Kp.(°C.) | Fp.(°C.) |
|---|---|---|---|---|---|
| 1. | $CH_3$ | $CH_3$ | H | 130° (0,3) | |
| 2. | $C_2H_5$ | $C_2H_5$ | H | | 64–66° |
| 3. | $CH_3$ | $C_2H_5$ | H | | 75–76° |
| 4. | $C_2H_5$ | $CH_3$ | H | 135–140° (0,6) | |
| 5. | $CH_3$ | $(CH_2)_2 . CH_3$ | H | 135–140° (0,3) | |
| 6. | $CH_3$ | $CH . (CH_3)_2$ | H | 135–140° (0,3) | |
| 7. | $CH_3$ | $(CH_2)_2 . OCH_3$ | H | 180–185° (0,4) | |
| 8. | $CH_3$ | $(CH_2)_2 . OC_2H_5$ | H | 162–168° (0,6) | |
| 9. | $CH_3$ | $(CH_2)_2 . SO_2 . CH_3$ | H | nicht destillierbares Öl | |
| 10. | $CH_3$ | $(CH_2)_2 . SO_2 . C_2H_5$ | H | " | |
| 11. | $CH_3$ | $(CH_2)_2 . Cl$ | H | 135–150° (0,5) | |
| 12. | $CH_3$ | $(CH_2)_2 . \overset{\oplus}{N}(CH_3)_3 \overset{\ominus}{Cl}$ | H | | |
| 13. | $C_2H_5$ | $(CH_2)_2 . CH_3$ | H | 140–145° (1,0) | |
| 14. | $C_2H_5$ | $CH . (CH_3)_2$ | H | 130–134° (0,5) | |
| 15. | $C_2H_5$ | $(CH_2)_2 . OCH_3$ | H | 160–165° (0,25) | |
| 16. | $C_2H_5$ | $(CH_2)_2 . OC_2H_5$ | H | 175–180° (0,25) | |
| 17. | $C_2H_5$ | $CH_2 . C_6H_5$ | H | 180–185° (0,15) | |

-continued

Compound according to formula IV

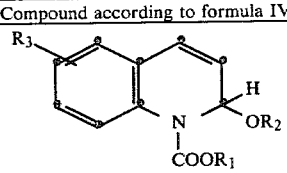

| Nr. | $R_1$ | $R_2$ | $R_3$ | Kp.(°C.) | Fp.(°C.) |
|---|---|---|---|---|---|
| 18. | $C_2H_5$ | $(CH_2)_2 . C_6H_5$ | H | 180–190° (0,15) | |
| 19. | $C_2H_5$ | $(CH_2)_2 . SO_2 . CH_2 . CH_3$ | H | nicht destillierbares Öl | |
| 20. | $C_2H_5$ | $(CH_2)_2 . Cl$ | H | 135–145° (0,5) | |
| 21. | $C_2H_5$ | $(CH_2)_2 . \overset{\oplus}{N}(CH_3)_3Cl^{\ominus}$ | H | | 140° (Zers.) |
| 22. | $C_2H_5$ | $(CH_2)_3 . CH_3$ | H | 137–139° (0,5) | |
| 23. | $(CH_2)_2 . OCH_3$ | $CH_3$ | H | 175–180° (0,3) | |
| 24. | $(CH_2)_2 . OCH_3$ | $(CH_2)_2 . OCH_3$ | H | 180–185° (0,3) | |
| 25. | $C_2H_5$ | $C_2H_5$ | (5)$SO_3Na$ | Sirup | |
| 26. | $C_2H_5$ | $C_2H_5$ | (8)$OCH_3$ | 160 (0.5) | |

The composition containing a polysaccharide and a quick-acting hardener is applied as external covering layer to the photographic material which consists of one or more hardenable layers. The layer of photographic material which is covered with this covering layer may still be moist or may already be dry at the moment when the covering layer is applied.

The process according to the invention is, in principle, also suitable for the preparation of photographic intermediate layers, e.g. in a multi-layered colour photographic material. To avoid difficulties of bonding when the following layers are applied, it is advisable to harden only partially, i.e. to reduce the quantity of hardener.

An aqueous solution of the composition according to the invention is generally used for preparing the covering layer although a mixture of water and water-miscible solvents may be used as solvent if necessary, for example in order to adjust the viscosity of the casting solution. Water-miscible solvents suitable for such purposes include alcohols such as methyl or ethyl alcohol, isopropyl alcohol and acetone. The solutions may contain the usual commercial wetting agents such as saponin, sulphonamine, succinic acid esters of nonionic compounds such as saccharose mono fatty acid esters, alkyl polyethylene glycols and fluoroalkyl sulphonic acids.

The quantities of polysaccharide and hardener to be employed depend mainly on the nature of the material which is required to be hardened, the number and thickness of the layers to be hardened, the quantity of composition applied and the polysaccharide used. The usual commercial polysaccharides, e.g. those supplied by KELCO and graded HV (High-Viscosity), MV (Medium-Viscosity) and LV (Low-Viscosity) allow for wide variations in the quantity applied wet or the resulting thickness of the layer. Satisfactory results are generally obtained with casting solutions which contain 1 to 20 g of polysaccharide and 5 to 50 g of hardener per 1000 ml of water applied in a quantity corresponding to 20 to 100 g/m$^2$ when wet if the solutions are required for hardening a photographic three-colour negative material of conventional structure. A photographic material treated in this way will in any case be able to withstand the mechanical stresses produced by machine processing at 30° to 40° C. after it has been dried and stored for one day. Without taking into account the structure of the photographic material it may be said that 0.5 to 10% by weight of hardener used according to the invention, based on the dry weight of the binder which is required to be hardened, is sufficient to produce a photographic material which can be processed at 30° to 40° C.

The composition employed according to the invention, consisting of polysaccharide and quick-acting hardener, may contain both polysaccharides and quick-acting hardeners either individually or as mixtures. The composition may advantageously also be used for hardening photographic layers which contain, in addition to gelatine, also other carboxyl-containing homopolymers and copolymers as binders. It is assumed that the quick-acting hardeners contained in the composition are capable of bringing about crosslinking of gelatine and polymers which contain carboxyl groups.

The advantage of the present invention as relating to the application of quick-acting hardeners is demonstrated in the means that may be employed for applying the composition according to this invention. This advantage is not relevant with respect to slow-acting hardeners because the problems in application dealt with in the present invention do not exist in the application of conventional slow-acting hardeners applied in conventional methods.

Any of the usual methods for preparing layers may be employed for applying the composition consisting of polysaccharide and quick-acting hardener. The composition according to the invention may therefore also be applied using casting apparatus of the kind which are generally not suitable for quick-acting hardeners, such as the application devices already mentioned above which operate with reflux.

The application apparatus operating with reflux which may be used for this purpose include in general those devices in which the casting solution which is required to be applied has the opportunity to react with the quick-acting hardener during the coating process before it is carried away by the material which is coated with it. This situation arises when, for example, casting solution is first applied in excess to the film and the excess is then removed, e.g. by stripping, and return to the casting system or else the solution which is ready for casting is circulated through pumps within the application system and the quantity of casting solution required for application is removed from the cycle.

Where the dipping process is employed, the substrate on which the solution is to be cast is moved under a casting roller through a storage container for the casting solution. The quantity corresponding to the amount of casting solution consumed is continuously supplied to the storage container. Quick-acting hardeners are therefore liable to interfere with the casting process by increasing the viscosity of the casting solution in the storage container.

The vacuum airbrush process constitutes a further development of the airbrush process in which part of the casting solution applied by the dipping process is blown away by a stream of air from a slot nozzle and returned to the storage container.

In contrast to the airbrush process described above, in the vacuum airbrush process the casting solution is blown off by a stream of air which flows into a vacuum chamber from the surrounding atmosphere. In this case again, the casting solution blown off by the air stream is returned to the casting apparatus. Part of the casting solution pumped into the casting device is discharged from the device at the inlet end of the web and wets the web.

In the suction casting apparatus, the casting solution is discharged from a narrow gap and reaches the web from below. The solution is carried for a short path in a gap between the web and the casting device and the layer then forms at the front edge of the casting device. In suction casting, the casting device is operated with a vacuum at the feed gap. A condition for the operation of a suction casting device is that the casting solution must be maintained at a certain viscosity (e.g. 6 cP).

Since a flow profile is formed as the casting solution is passed through the feed system of the casting device so that the flow velocity progressively drops or the flow ceases all together, especially at the edges of the channels formed by the gaps, partial changes in viscosity occur after only a short time in operation when a quick-acting hardener is used, and these viscosity changes interfere with the casting process.

Experts in the art of the preparation of photographic layers will be familiar with the application systems described in the above examples. A description of application methods commonly used in photography may be found e.g. in "Ullmanns Encyclopädie der technischen Chemie", 3rd Edition, volume 13 (1962), pages 641 to 645. The description also contains information on special casting forms. Information on the suction casting devices mentioned in the examples may be found e.g. in U.S. Pat. Nos. 3,645,773 and 3,663,292 and in British Pat. No. 1,216,066; 1,219,223; 1,219,224 and 1,219,225. A description of the vacuum airbrush casting device may be found in U.S. Pat. No. 3,635,192 and 3,654,889; British Pat. No. 1,229,374 or German Pat. No. 1,577,722.

Thus it is seen that the application of the composition of this invention in the process of this invention provides the advantage of adaptation of the coating process to the various application systems and methods while deriving the benefit of the quick-acting hardeners over the slow-acting hardeners. Also as described elsewhere in this disclosure in greater detail the polysaccharide provides the advantage of forming a film compatible with the photographic purposes of the processed photographic material.

By photographic materials are meant in this context any materials in general which contain layers used in photographic materials. Such layers include, for example, light-sensitive silver halide emulsion layers; protective layers; filter layers; antihalation layers; back-coating layers or photographic auxiliary layers in general.

Among the light-sensitive emulsion layers which are particularly suitable for the hardening process according to the invention may be mentioned, for example, those layers which are based on unsensitised X-ray or other spectrally sensitised emulsions. The hardening process according to the invention is also suitable for hardening the gelatine layers used for various black-and-white and colour photographic processes. The process according to the invention has proved to be particularly suitable for hardening photographic compositions of layers used for carrying out colour photographic processes, e.g. those containing emulsion layers with colour couplers or emulsion layers designed to be treated with solutions which contain colour couplers.

Photographic layers intended to be hardened by the process according to the invention may, in addition to the usual photographic additives, contain other, conventional hardeners which are not quick-acting, for example formalin, mucochloric acid, triacryloformal and dialdehydes or any inorganic salts such as chromium-III, aluminium-III or zirconium salts.

In addition to gelatine, the photographic layers may contain water-soluble high polymer compounds, in particular polyvinyl alcohol, polyacrylic acid sodium and other copolymers which contain carboxyl groups, or polyvinyl pyrrolidone, polyacrylamide or high-molecular weight natural substances such as dextranes, dextrines, starch ether, alginic acid or alginic acid derivatives.

The following methods were employed to determine the experimental results described in the examples.

The hardening of the photographic materials is assessed in terms of the melting point of the layers, which can be determined as follows: The layer composition cast on a substrate is half dipped in water which is continuously heated to 100° C. The temperature at which the layer runs off the substrate (formation of streaks) is termed the melting point or melting-off point. Unhardened protein or gelatine layers never show an increase in melting point when this method of measurement is employed. The melting-off point obtained under these conditions is 30° to 35° C.

To determine the water-absorption, the test sample is developed as a black sheet by a conventional colour development process and after the final bath and stripping to remove excess water, it is weighed. The sample is then dried and re-weighed. The difference between the two weighings divided by the surface area of the sample in $m^2$ is the water absorption per $m^2$.

Swelling is determined gravimetrically after 10 minutes' treatment of a sample strip in distilled water at 22° C. It is defined by the swelling factor:

$$\frac{\text{Weight of layer wet}}{\text{Weight of layer dry}} = \text{swelling factor.}$$

To determine the wet scratch resistance, a metal tip of specified size is passed over the wet layer and loaded with a progressively increasing weight. The weight scratch resistance is indicated by the weight at which the tip leaves a visible scratch trace on the layer. A high weight corresponds to a high wet scratch resistance.

The $\alpha$-value is determined by the usual method employed in photographic practice.

The hardening process according to the invention succeeds in a surprising manner in solving the problems which arise when quick-acting hardeners are used and which have previously seriously restricted the use of such hardeners. By means of the process according to the invention it is now possible to use quick-acting hardeners regardless of the coating system available for preparing the photographic material and the advantages of such hardeners can be fully utilised, for example for the preparation of photographic materials which are suitable for processing at elevated temperatures and which have therefore achieved a position of major commercial importance.

EXAMPLE 1

Solutions of hardeners are applied under identical conditions by the immersion process to an unhardened, dry emulsion layer 5μ in thickness which contains in each case 80 g of gelatine, 35 g of silver bromide and 24 g of the water-soluble colour component 1-hydroxy-4-sulpho-2-naphthoic acid heptadecylamide. The solutions of hardeners are digested for 1 hour at 40° C. The layers are dried. Hardening is determined in terms of the swelling factor and wet strength values immediately after drying and after a storage time of 36 hours at 56° C. and 34% relative humidity. The quantity of hardener used is adjusted so that layers which are fast to boiling are obtained in all cases. The following solutions of hardeners are applied:

Solution 1: 1 mol-% of compound 1 in 1% gelatine solution

Solution 2: 1 mol-% of compound 1 in 0.2% cellulose sulphate solution (Kelco SCS MV)

Solution 3: 1 mol-% of compound 2 in 1% gelatine solution

Solution 4: 1 mol-% of compound 2 in 0.2% cellulose sulphate solution

Solution 5: 1 mol-% of compound 3 in 1% gelatine solution

Solution 6: 1 mol-% of compound 3 in 0.2% cellulose sulphate solution

Solution 7: 1 mol-% of compound 4 in 1% gelatine solution

Solution 8: 1 mol-% of compound 4 in 0.2% cellulose sulphate solution

Solution 9: 1 mol-% of compound 5 in 1% gelatine solution

Solution 10: 1 mol-% of compound 5 in 0.2% cellulose sulphate solution

Solution 11: 1 mol-% of compound 6 in 1% gelatine solution

Solution 12: 1 mol-% of compound 6 in 0.2% cellulose sulphate solution.

The compounds indicated above are the hardeners defined by the following formulae. They are also referred to by the same numbers in the following examples.

Compounds 1 to 6

Verbindung 1

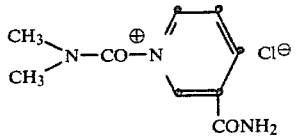

Verbindung 2

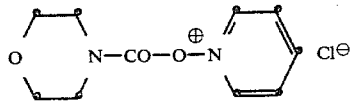

Verbindung 3

-continued

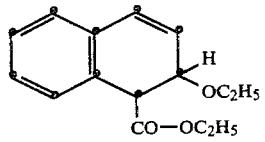

Verbindung 4

$C_2H_5-N=C=N-CH_2-CH_2-CH_2-\overset{+}{N}(CH_3)_2\ Cl^{\ominus}$ (H)

Verbindung 5

$CH_3-N=C=N-CH_2-CH_2-CH_2-\overset{+}{N}(CH_3)_2\ Cl^{\ominus}$ (H)

Verbindung 6

$C_2H_5-N=C=N-CH_2-CH_2-O-CH_3$

The following results are obtained: The melting points of the layers are all above 100° C.; the swelling factors and wet strength values are determined at 20° C. in water before the materials are processed. The values obtained are shown in Table 1:

TABLE 1

| | Determination immediately after drying | | After air conditioning for 36 hours at 57° C./34% relative humidity | |
|---|---|---|---|---|
| Solution No. | Swelling factor 20° C. | Wet strength in p | Swelling factor | Wet strength in p |
| 1 (comparison) | 3.8 | 1000 | 3.9 | 1000 |
| 2 | 3.0 | 1200 | 3.1 | 1200 |
| 3 (comparison) | 3.3 | 800 | 3.1 | 900 |
| 4 | 2.9 | 900 | 2.9 | 900 |
| 5 (comparison) | 6.2 | 400 | 6.5 | 400 |
| 6 | 5.1 | 500 | 5.3 | 500 |
| 7 (comparison) | 4.4 | 650 | 4.8 | 700 |
| 8 | 4.1 | 650 | 4.5 | 700 |
| 9 (comparison) | 3.3 | 750 | 3.3 | 850 |
| 10 | 2.9 | 850 | 3.1 | 950 |
| 11 (comparison) | 3.2 | 800 | 3.5 | 850 |
| 12 | 3.0 | 850 | 3.2 | 950 |

The table shows that the solutions prepared using cellulose sulphate as colloid have a higher hardening activity (lower swelling factor and higher wet strength). The films prepared with cellulose sulphate solution are photographically intact, i.e. they show no fogging and no changes in sensitivity.

EXAMPLE 2

A colour photographic material designed to be viewed by reflected light is prepared by applying the following layers successively to a paper substrate backed with polyethylene and covered with adhesive layer, the emulsion layers containing the usual additions of wetting agents, stabilisers, etc.:

1. As bottom layer a 4μ thick blue-sensitive silver bromide emulsion layer containing, per kg of emulsion, 25.4 g of silver (88% AgBr, 12% AgCl), 80 g of gelatine and 34 g of the yellow component

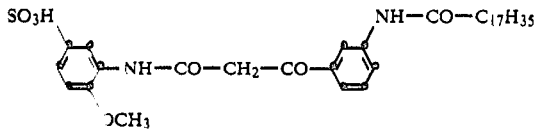

2. as intermediate layer, a 1μ thick gelatine layer,
3. as middle layer a 4μ thick green-sensitive silver chlorobromide emulsion layer containing, per kg of emulsion, 22 g of silver (77% AgCl, 23% AgBr), 80 g of gelatine and 13 g of the purple component

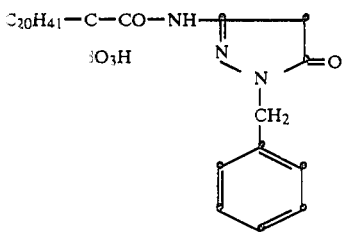

4. a 1μ thick intermediate layer as described under 2,
5. as top layer a 4μ thick red-sensitive silver chlorobromide emulsion layer containing, per kg of emulsion, 23 g of silver (80% AgCl, 20% AgBr), 80 g of gelatine and 15.6 g of the cyan component

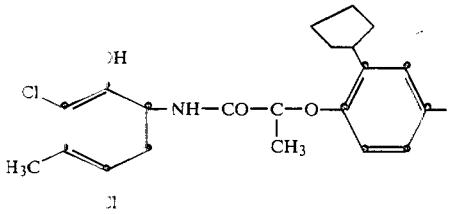

6. a 1μ thick protective layer having one of the compositions mentioned below under 6.1–6.7. The protective layers are applied by the vacuum airbrush process described.

| | | |
|---|---|---|
| 6.1 | Cellulose sulphate KELCO SCS MV | 10 g |
| | water | 980 ml |
| | 10% aqueous saponin solution | 20 ml |
| | compound 1 | 10 g |
| 6.2 | Cellulose sulphate KELCO SCS HV | 2 g |
| | Water | 980 ml |
| | 10% saponin solution | 20 ml |
| | compound 1 | 10 g |
| 6.3 | Cellulose sulphate KELCO SCS HV | 5 g |
| | Water | 980 ml |
| | 10% saponin solution | 20 ml |
| | compound 2 | 5 g |
| 6.4 | Cellulose sulphate KELCO SCS HV | 1.5 g |
| | Cellulose sulphate KELCO SCS LV | 10.0 g |
| | water | 980 ml |
| | 10% saponin solution | 20 ml |
| | compound 2 | 10 g |
| 6.5 | Cellulose sulphate KELCO SCS MV | 10 g |
| | water | 980 ml |
| | 10% saponin solution | 20 ml |
| | compound 4 | 10 g |
| 6.6 | Cellulose sulphate KELCO SCS LV | 15 g |
| | water | 980 ml |
| | 10% saponin solution | 20 ml |
| | compound 4. | 15 g |
| 6.7 | Polysaccharide B-1459 (KELZAN) | 2.5 g |
| | Water | 980 ml |

-continued

| | |
|---|---|
| 10% saponin solution | 20 ml |
| compound 1 | 10 g |

The samples covered with protective layers 6.1 to 6.7 all have completely satisfactory casting properties and their layer melting points after drying are above 100° C.

EXAMPLE 3

A colour photographic material designed to be viewed by reflected light and having the composition indicated in example 2 is coated with a 1μ thick protective layer (6.) as described in example 2 but using the following compositions instead of those indicated in example 2:

| | | |
|---|---|---|
| 1. | Gelatine | 50 g |
| | water | 950 ml |
| | 10% aqueous saponin solution | 20 ml |
| | compound 1 | 10 g |

2. In the composition described under 1. above, the 5% gelatine solution is replaced by a 0.5% gelatine solution and compound 1 is replaced by compound 2.

| | | |
|---|---|---|
| 3. | Polyvinyl alcohol (molecular weight 50,000) | 15 g |
| | water | 980 ml |
| | 10% aqueous saponin solution | 20 ml |
| | compound 1 | 10 g |

4. In the composition described under 3. above, compound 1 is replaced by compound 2.
5. In the composition described under 3. above, compound 1 is replaced by compound 4.

| | | |
|---|---|---|
| 6. | Polyvinyl pyrrolidone | 30 g |
| | water | 970 ml |
| | 10% aqueous saponin solution | 20 ml |
| | compound 1 | 10 g |

7. In the composition described under 6, above, compound 1 is replaced by compound 2.
8. In the composition described under 6. above, compound 1 is replaced by compound 4.

When cellulose sulphate is replaced by gelatine in the composition of the protective layer (experiments 1 and 2), the application of the layer is in all cases faulty if the airbrush process is employed, which operates with reflux. When gelatine solutions of medium concentration are employed. (experiment 1), the application system is blocked after a short time so that application of the layer cannot be continued. Gelatine solutions of low concentrations (experiment 2) lead to faults in coating and hardening.

When cellulose sulphate is replaced by polyvinyl alcohol (experiments 3 to 5), uncontrollable fluctuations in the quantity of coating solutions applied occur in the same way as when using gelatine solutions of medium or low viscosity, and hence hardening of the photographic material is uneven. To this is added the fact that when material is treated in this way, the layer tends to become detached when it is subsequently processed.

The undesirable results described above are also obtained when cellulose sulphate is replaced by polyvinyl pyrrolidone (experiments 6.–8.).

EXAMPLE 4

A colour photographic material designed to be viewed by reflected light similar to that used in example 2 is covered with a protective layer (6.) by applying an aqueous casting solution in an amount of 55 g/m² by means of a suction casting device. The solution contains the following components per liter:

| | | |
|---|---|---|
| 1. | Cellulose sulphate KELCO SCS-MV | 10 g |
| | 4% aqueous saponin solution | 20 ml |
| | compound 1 | 10 g |

Individual samples of the photographic material designed to be viewed by reflected light are coated in the same way with protective layers of the following composition:

2. In the casting solution of sample 1, 15 g of compound 2 are used instead of compound 1.
3. In the casting solution of sample 1, 17.5 g of compound 4 are used instead of compound 1.
4. The casting solution of sample 1 is altered in that instead of the given quantity of cellulose sulphate, an equal quantity of a 6% aqueous gelatine solution is used. Whereas no difficulties in casting occur in the preparation of samples 1 to 3 and both the mechanical and the photographic properties of the dried samples are without defect, the solution of sample 4 is applied in streaks only shortly after the beginning of the casting operation and after only 3 minutes the casting apparatus is so completely blocked that no further application is possible.

What is claimed is:

1. The process of hardening a photographic material comprising at least one layer comprised of a light-sensitive silver halide emulsion and at least one layer containing a binder comprised of gelatin which comprises the step of applying to at least one layer containing gelatin a coating of a composition consisting essentially of from 5 to 500 g per 1000 ml of water of a quick acting hardener which acts by activating carboxyl groups present in the gelatin selected from the group consisting of (a) a compound of the following general formula

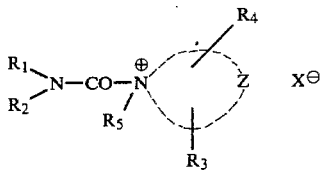

wherein $R_1$=an unsubstituted or substituted alkyl, aryl or aralkyl group, $R_2$=either (1) an unsubstituted or substituted alkyl, aryl or aralkyl group and has the same meaning as $R_1$ or (2) an alkyl, aryl, aralkyl or alkyl-aryl-alkyl group which is substituted with another carbamoyl ammonium group of the formula

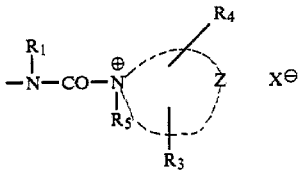

or $R_1$ and $R_2$ together form the atoms required for completing a substituted or unsubstituted heterocyclic ring;

$R_3$=hydrogen, alkyl or the group $\vdash A \dashv$ wherein A denotes a vinyl group of a polymerisable vinyl compound or of a copolymer with other copolymerisable monomers and $\alpha$ represents a number such that the molecular weight of the compound is greater than 1000, $R_4$=hydrogen, or alkyl or, where Z denotes the atomic group required for completing a pyridinium ring and $R_3$ is absent, $R_4$ denotes a formylamino, acrylamino ureido group substituted or unsubstituted on the nitrogen atom, an alkyl group substituted with acylamino or ureido groups which in turn may be substituted, a substituted or unsubstituted amido group, or alkyl which is substituted with an optionally substituted amido group, a straight chain or branched chain alkyl substituted with hydroxyl, alkyl, formyloxy, acyloxy or optionally substituted carbamoyloxy, a straight chain or branched chain alkyl substituted with amino, alkylamino, formylamino, acylamino or a ureido group;

$R_5$=alkyl, aryl or aralkyl but $R_5$ is absent if the nitrogen atom to which $R_5$ is attached carries a double bond in the heterocyclic aromatic ring formed by Z, Z=the group of atoms required for completing a 5-membered or 6-membered substituted or unsubstituted heterocyclic aromatic ring, including a condensed ring system, which group may include one or more additional heteroatoms, and X=an anion, (b) a carbamoyloxy pyridinium of the general formula

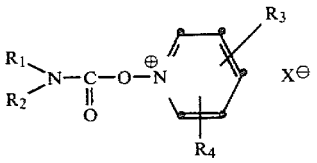

wherein $R_1$=alkyl or aryl, $R_2$=alkyl or the group

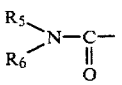

$R_5$ denotes hydrogen or alkyl and $R_6$ denotes alkyl, $R_1$ and $R_2$ together represent the atoms required for completing a heterocyclic ring system such as a pyrrolidine-, morpholine-, piperidine-, perhydrozepine, 1,2,3,4-tetrahydroquinoline or imidazolidine-2-one ring or $R_1$ and $R_2$ together represent the atoms required for completing a piperazine ring in which the second nitrogen atom establishes the connection to a second, similar carbamoyloxy pyridinium molecular grouping corresponding to the general formula,

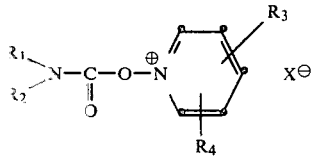

$R_3$=hydrogen, halogen, alkyl, hydroxyalkyl, cyanogen, CONH or $$-NH-\overset{O}{\overset{\|}{C}}-O$$

alkyl $R_4$=hydrogen or alkyl and

X=anion, (c) a carbodiimide of the general formula $$R_1-N=C=N-R_2$$

wherein $R_1$ and $R_2$=identical or different alkyl, alkoxyalkyl or optionally substituted aryl groups or a 5-membered optionally substituted heterocyclic ring or $R_1$=alkyl containing 1-5 C-atoms and $R_2$=the group

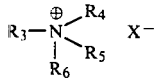

wherein $R_3$=alkyl containing 1-5 C-atoms, $R_4$ and $R_5$=alkyl containing 1-3 C-atoms or $R_4$ and $R_5$ together form a 6-membered heterocyclic ring containing one or two hetero atoms, $R_6$=H or a lower alkyl and X=an anion, and (d) a dihydroquinoline of the general formula

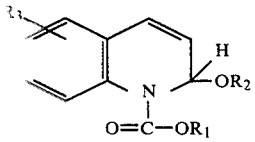

wherein $R_1$=unsubstituted or substituted alkyl, $R_2$=unsubstituted or substituted alkyl or aralkyl or, when $R_3$=H, $R_2$ denotes the group

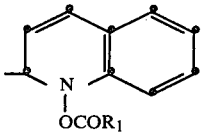

$R_3$=hydrogen, halogen, alkyl, alkoxy and 1 to 20 g of a polysaccharide which being free of carboxyl groups does not react with said quick-acting hardener and which is a linear polymer in which either (1) at least one third of the monosaccharide units have a 1-2-bond and the remaining monosaccharide units have a 1-4-bond or (2) substantially all the monosaccharide units have a 1-4 bond and at least 50% of the hydroxyl group of the monosaccharide units are acetylated or replaced by an $OSO_3Me$ group, wherein Me denotes an alkali metal whereby the carboxyl activity of said hardener has an onset subsequent to the application of the composition to the gelatin containing layer.

2. Process according to claim 3, characterised by the use of a hardener of the general formula

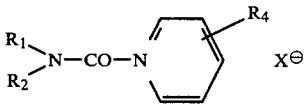

wherein $R_1$, $R_2$ and X have the meaning indicated above and $R_4$ represents

| | |
|---|---|
| $-NR^6-CO-R^7$ | $R^6$ = H, alkyl (1-4C)<br>$R^7$ = H, alkyl (1-4C)<br>$=NR^8R^9$<br>$R^8$, $R^9$ = H, alkyl ($C_1$-$C_4$) |
| $-(CH_2)_m-NR^{10}R^{11}$ | $R^{10}$ = $-CO-R^{12}$<br>$R^{11}$ = H, alkyl ($C_1$-$C_4$)<br>$R^{12}$ = H, alkyl ($C_1$-$C_4$)<br>$R^{12}$ = $NR^{13}R^{14}$<br>$R^{13}$ = alkyl ($C_1$-$C_4$), aryl<br>$R^{14}$ = H, alkyl, aryl<br>m = 1-3 |
| $-(CH_2)_n-CONR^{15}R^{16}$ | $R^{15}$ = H, alkyl ($C_1$-$C_4$), aryl<br>$R^{16}$ = H, alkyl ($C_1$-$C_4$)[or $R^{15}$ and $R^{16}$ together form the group of atoms required for completing a 5-membered or 6-membered aliphatic ring]<br>n = 0-3 |
| $-(CH_2)_p-\underset{\underset{R^{18}}{\vert}}{\underset{Y}{\underset{\vert}{CH}}}-R^{17}$ | $R^{17}$ = H, alkyl ($C_1$-$C_4$)[optionally substituted by halogen]<br>Y = $-O-$, $NR^{19}-$<br>$R^{18}$ = H, alkyl, $-CO-R^{20}$, $-CO-NHR^{21}$<br>$R^{19}$, $R^{20}$, $R^{21}$ = H, alkyl ($C_1-C_4$)<br>p = 2-3 |

* * * * *